US006883986B2

(12) United States Patent
Woo

(10) Patent No.: US 6,883,986 B2
(45) Date of Patent: Apr. 26, 2005

(54) METHOD AND APPARATUS FOR ADJUSTING PRINTING WIDTH OF PRINTING PAPER

(75) Inventor: Hong-rok Woo, Gyeonggi-do (KR)

(73) Assignee: Sansung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/706,268

(22) Filed: Nov. 13, 2003

(65) Prior Publication Data

US 2004/0141788 A1 Jul. 22, 2004

(30) Foreign Application Priority Data

Dec. 10, 2002 (KR) ..... 10-2002-0078159

(51) Int. Cl.[7] ..... B41J 11/42; B41J 11/44; B41J 21/17

(52) U.S. Cl. ..... 400/582; 400/76; 400/70

(58) Field of Search ..... 400/582, 76, 70, 400/61, 74; 101/486, 33; 347/19, 37

(56) References Cited

U.S. PATENT DOCUMENTS

| | | | | | |
|---|---|---|---|---|---|
| 1,784,037 | A | * | 12/1930 | Wolf | 101/152 |
| 2,599,430 | A | * | 6/1952 | Beuerman | 83/76 |
| 2,711,121 | A | * | 6/1955 | Barsam, Sr. | 355/101 |
| 3,264,164 | A | * | 8/1966 | Jerothe et al. | 428/29 |
| 3,828,153 | A | * | 8/1974 | Hagstrom et al. | 200/18 |
| 3,972,280 | A | * | 8/1976 | Swatik et al. | 101/93.16 |
| 4,150,902 | A | * | 4/1979 | Brescia | 400/17 |
| 4,780,006 | A | * | 10/1988 | Hamano et al. | 400/124.07 |
| 4,982,636 | A | * | 1/1991 | Becking | 83/167 |
| 5,200,761 | A | * | 4/1993 | Kawakita et al. | 347/183 |
| 5,861,726 | A | * | 1/1999 | Uchikata et al. | 318/685 |
| 6,032,949 | A | * | 3/2000 | Ando | 271/225 |
| 6,263,796 | B1 | * | 7/2001 | Jordan | 101/486 |
| 6,597,466 | B1 | * | 7/2003 | Katayama | 358/1.13 |

FOREIGN PATENT DOCUMENTS

| | | | | |
|---|---|---|---|---|
| JP | 63112160 | * | 5/1988 | B41J/3/10 |
| JP | 5-64938 | | 3/1993 | |
| JP | 40904030303 A | * | 7/1995 | B65H/85/00 |
| JP | 10193664 | * | 7/1998 | B41J/2/365 |
| JP | 11043265 | * | 2/1999 | B65H/85/00 |
| JP | 2001-48430 | | 2/2001 | |

* cited by examiner

*Primary Examiner*—Andrew H. Hirshfeld
*Assistant Examiner*—Wasseem H. Hamdan
(74) *Attorney, Agent, or Firm*—Staas & Halsey LLP

(57) ABSTRACT

A method and apparatus to adjust a printing width of a printing paper. The method includes modifying a previously-provided width decision value used to decide the width of the printing paper or a previously-provided height decision value used to decide a height of the printing paper, deciding a speed value of the motor placed horizontally and a speed value of the motor placed vertically from the modified width decision value or the modified height decision value, and driving the motors placed horizontally and vertically in accordance with the decided speed values of the motors placed horizontally and vertically and printing the data.

19 Claims, 5 Drawing Sheets

METHOD AND APPARATUS FOR ADJUSTING PRINTING WIDTH OF PRINTING PAPER

CROSS-REFERENCE TO RELATED APPLICATIONS

This application claims the priority of Korean Patent Application No. 2002-78159, filed on Dec. 10, 2002, in the Korean Intellectual Property Office, the disclosure of which is incorporated herein in its entirety by reference.

BACKGROUND OF THE INVENTION

1. Field of the Invention

The present invention relates to a printer that prints data by driving motors placed horizontally and vertically, and more particularly, to a method and apparatus that adjusts a printing width of a printing paper where a printing operation is performed by driving motors placed horizontally and vertically in accordance with relative speed values of the motors.

2. Description of the Related Art

A printer receives data on a document made using an application from a host and performs a printing operation in accordance with the information and basic values that are set in the printer. In this case, the printer controls the speed of the motors placed horizontally and vertically, so as to print data on a printing paper. The speed of the motors is a substantially important value, so that an image can be printed on the paper to a correct width. In order to control the speed of the motors placed horizontally and vertically in the printer, speed values of the motors obtained through experiments are fixed in a process to manufacture the printer. That is, the speed values of the motors are fixed and stored as fixed values by considering physical elements such as the temperature and characteristics of devices during a development process and synthesizing experienced values and theoretical values.

However, although similar when seen with the naked eye, when based on an exact measurement, a difference exists in the height and width of the printing paper during a printing operation from printer to printer. Therefore, a difference in the height or width of the printing paper occurs in printing material requiring a correct printing position, such as a specific format, for example, an optical character recognition (OCR) font, from printer to printer.

SUMMARY OF THE INVENTION

The present invention provides a method of adjusting a printing width of a printing paper by which a printing operation is preformed by adjusting relative speed values of motors placed horizontally and vertically.

The present invention also provides an apparatus that adjusts a printing width of a printing paper in which the method of adjusting a printing width of a printing paper is implemented.

According to an aspect of the present invention, there is provided a method of adjusting a printing width of a printing paper performed in a printer that drives motors placed horizontally and vertically and printing data. The method comprises modifying a previously-provided width decision value used to decide a width of the printing paper or a previously-provided height decision value used to decide a height of the printing paper, deciding a speed value of the motor placed horizontally and a speed value of the motor placed vertically from the modified width decision value or the modified height decision value, and driving the motors placed horizontally and vertically in accordance with the decided speed values of the motors placed horizontally and vertically and printing the data.

According to another aspect of the present invention, there is provided an apparatus that adjusts a printing width of a printing paper included in a printer that drives motors placed horizontally and vertically and printing data. The apparatus includes a printing width value modification unit which has a width decision value to decide a width of the printing paper, or a height decision value to decide a height of the printing paper, modifies the width decision value or the height decision value in response to a user's modification request signal, and outputs the result of modification, a speed value decision unit which decides speed values of the motors placed horizontally and vertically in response to the result of modification and outputs the results of the decision, and a motor drive controlling unit which drives the motors placed horizontally and vertically, in accordance with the decided speed values of the motors in response to the results of the decision.

Additional and/or other aspects and advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the preferred embodiments taken in conjunction with the accompanying drawings in which.

DETAILED DESCRIPTION OF THE PREFERRED EMBODIMENTS

Figure 1:
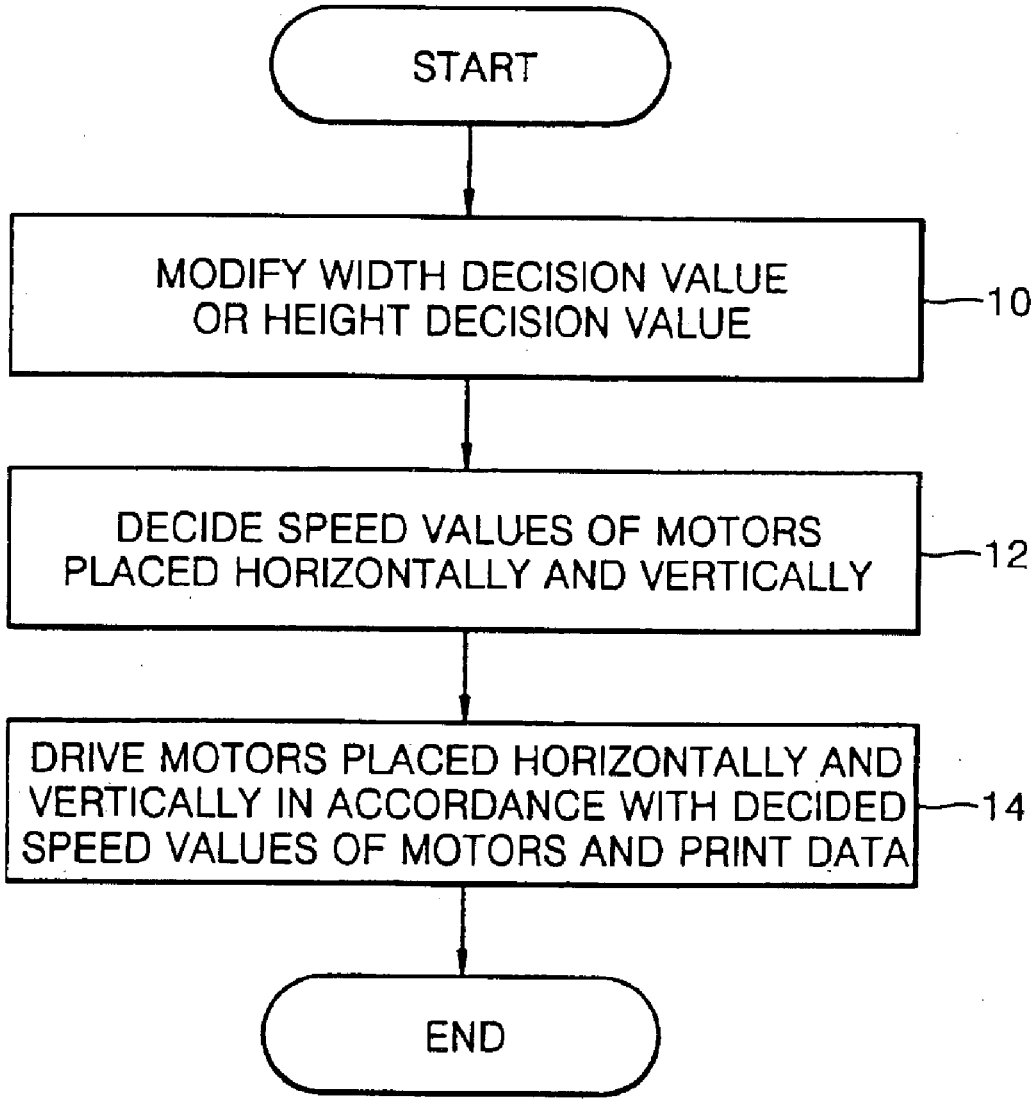
FIG. 1 is a flowchart illustrating an embodiment of a method of adjusting a printing width of a printing paper according to the present invention.

Reference will now be made in detail to a method of adjusting a printing width of a printing paper according to an embodiment of the present invention which will be described with reference to the accompanying drawings, wherein like reference numerals refer to the like elements throughout. The embodiments are described below in order to explain the present invention by referring to the figures.

FIG. 1 is a flowchart illustrating an embodiment of a method of adjusting a printing width of a printing paper according to the present invention. The method comprises the operations 10 through 14 of driving motors placed horizontally and vertically in accordance with decided speed values of the motors and printing data.

First, in operation 10, a width decision value used to decide a width of a printing paper, or a height decision value used to decide a height of the printing paper (where, the width decision value and the height decision value are provided beforehand) is modified. In an embodiment of the invention, the width decision value is indicated by a percent value used to decide a speed value of the motor placed horizontally, which will be described later. Also, although the height decision value is indicated by a percent value used to decide a speed value of the motor placed vertically, which will be described later, it may be indicated in another unit. When the width decision value and the height decision value are initially provided, they have the same value. That is, the width decision value and the height decision value are provided as 100%, respectively. The initially-provided same width decision value and height decision value become a reference value K, which will be described later. The initially-provided width decision value and height decision value are modified according to a user's selection. If the modified width decision value or the modified height decision value is modified twice, the first-modified width decision value or the first-modified height decision value becomes the previously-provided width decision value or the previously-provided height decision value.

After operation 10, in operation 12, speed values of the motors placed horizontally and vertically are decided from the modified width decision value or the modified height decision value. The speed values of the motors placed horizontally and vertically are relative motor speed values between the motors driven during a printing operation. Operation 14, in which drive motors are placed horizontally in accordance with decided speed values of motors and print data, will be described later.

Figure 2:
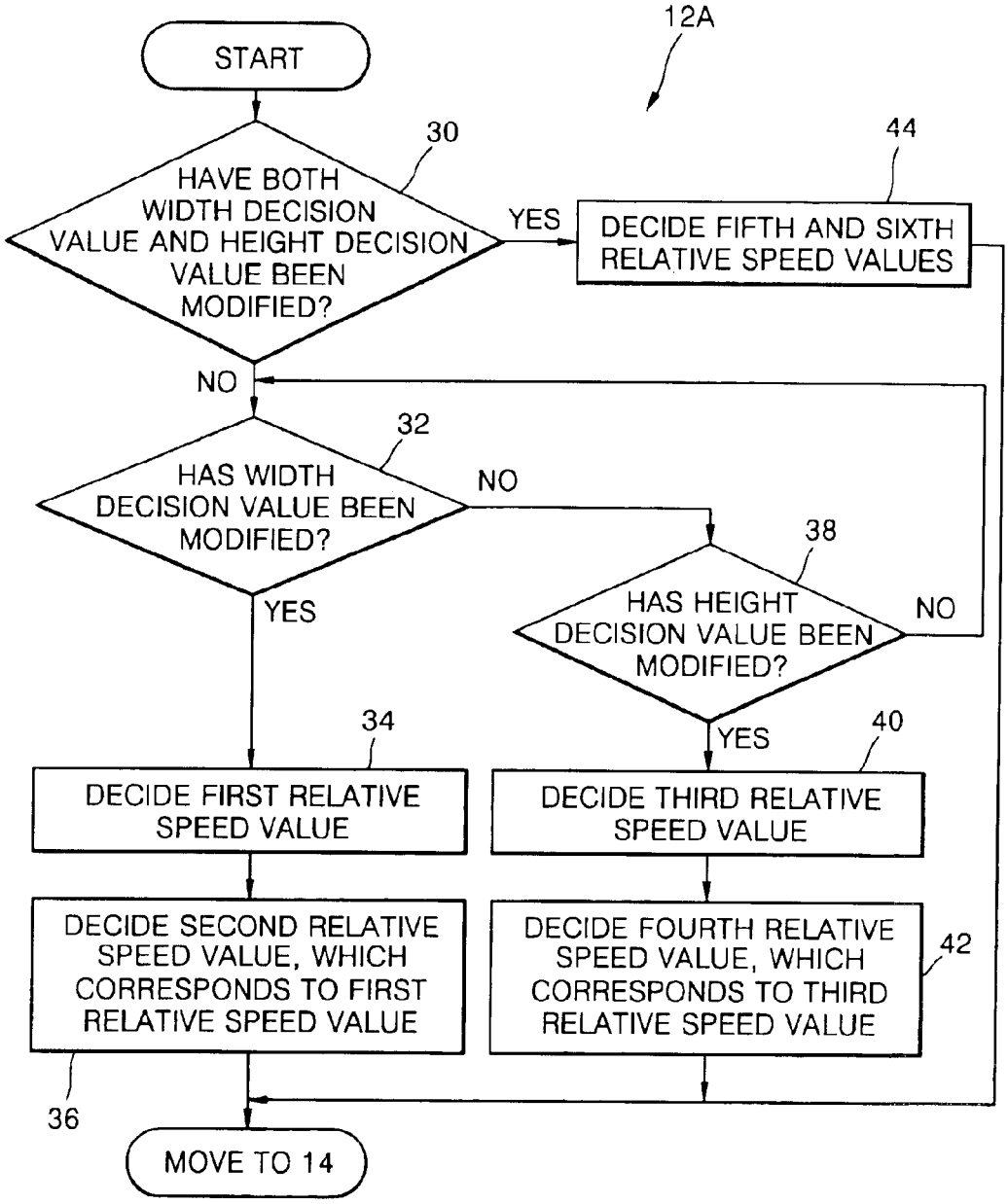
FIG. 2 is a flowchart illustrating an embodiment of operation 12 shown in FIG. 1, according to the present invention.

FIG. 2 is a flowchart illustrating an embodiment 12A of operation 12 shown in FIG. 1, according to the present invention. The embodiment 12A comprises the operations 30 through 44 of determining first through sixth relative speed values from the width decision value and the height decision value.

First, in operation 30, it is determined whether both the width decision value and the height decision value have been modified. If it is determined that both the width decision value and the height decision value have been modified, the embodiment 12A proceeds to operation 44.

However, if it is determined that both the width decision value and the height decision value have not been modified, in operation 32, it is determined whether the width decision value has been modified. If it is determined that the width decision value has not been modified, the embodiment 12A proceeds to operation 38.

However, if it is determined that the width decision value has been modified, in operation 34, a first relative speed value of the motor placed horizontally is decided. The first relative speed value is decided by Equation 1.

$$Sh1=Ha\times K\div Vf \quad (1)$$

(Here, Sh1 is a first relative speed value, Ha is a modified width decision value, K is a reference value with respect to the provided width decision value or the provided height decision value, and Vf is a provided height decision value.)

The reference value K corresponds to an initially-provided width decision value and an initially-provided height decision value. The initially-provided width decision value and the initially-provided height decision value are set to the same value. For example, if the provided width decision value and the provided height decision value are 100% respectively and the modified width decision value is 120%, the first relative speed value may be "120×100÷100=120" using Equation 1.

After operation 34, in operation 36, a second relative speed value of the motor placed vertically, which corresponds to the first relative speed value, is decided. The second relative speed value is decided by Equation 2.

$$Sv2=Vf\times K\div Sh1 \quad (2)$$

(Here, Sv2 is a second relative speed value.)

For example, by using the above-mentioned conditions and results assumed in operation 32, the second relative speed value may be "100×100÷120=10000/120" using Equation 2.

If it is determined in operation 32 that the width decision value is not modified, in operation 38, it is determined whether the height decision value is modified. If it is determined that the height decision value is not modified, the embodiment 12A proceeds to operation 32.

However, if it is determined that the height decision value is modified, in operation 40, a third relative speed value of the motor placed vertically is decided. The third relative speed value is decided by Equation 3.

$$Sv3=Va\times K\div Hf \quad (3)$$

(Here, Sv3 is the third relative speed value, Va is the modified height decision value, K is a reference value with respect to the provided width decision value or the provided height decision value, and Hf is the provided width decision value.)

For example, if the reference value K is 100, the provided width decision value and the provided height decision value are 100% respectively and the modified height decision value is 120%. Thus, the third relative speed value may be expressed as "120×100÷100=120" using Equation 3.

After operation 40, in operation 42, a fourth relative speed value of the motor placed horizontally, which corresponds to the third relative speed value, is decided. The fourth relative speed value is decided by Equation 4.

$$Sh4=Hf\times K\div Sv3 \quad (4)$$

(Here, Sh4 is the fourth relative speed value.)

For example, by using the above-mentioned conditions and results assumed in operation 40, the fourth relative speed value may be "100×100÷120=10000/120" using Equation 4.

Each of the above-mentioned first and fourth relative speed values corresponds to the speed value of the motor placed horizontally in operation 12, and each of the second and third relative speed values corresponds to the speed value of the motor placed vertically in operation 12.

If it is determined in operation 30 that both the width decision value and the height decision value have been modified, in operation 44, a fifth relative speed value of the motor placed horizontally and a sixth relative speed value of the motor placed vertically are decided.

Figure 3:
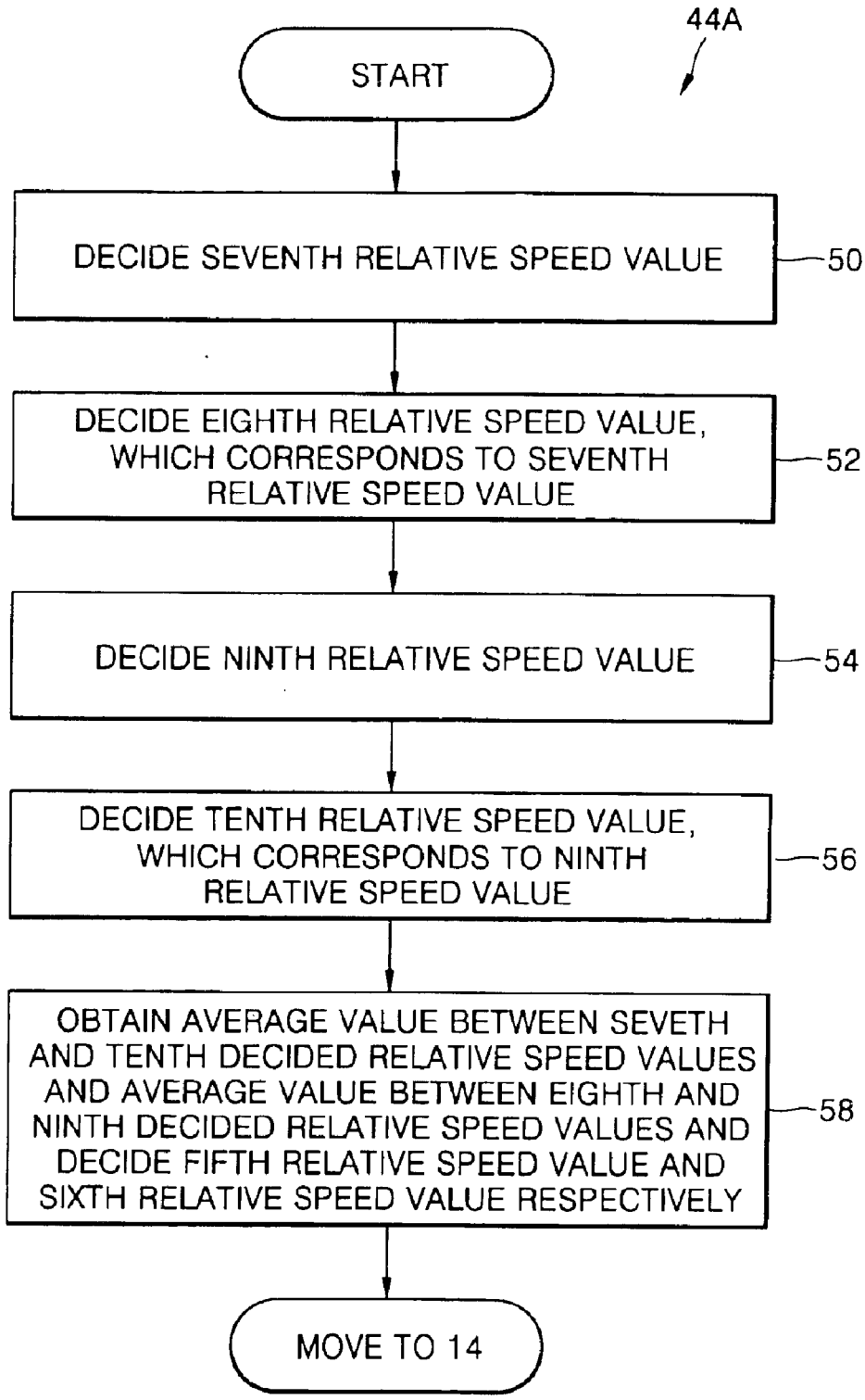
FIG. 3 is a flowchart illustrating an embodiment of operation 44 shown in FIG. 2, according to the present invention.

FIG. 3 is a flowchart illustrating an embodiment 44A of operation 44 shown in FIG. 2, according to the present invention. The embodiment 44A comprises the operations 50 through 58 of deciding an eighth relative speed value, which corresponds to a seventh relative speed value, and a tenth relative speed value, which corresponds to a ninth relative speed value, and obtaining an average value between the seventh decided relative speed value and the tenth decided relative speed value and an average value between the eighth decided relative speed value and the ninth decided relative speed value.

First, in operation 50, the seventh relative speed value of the motor placed horizontally is decided. The seventh relative speed value is decided by Equation 5.

$$Sh7=Ha\times K\div Vf \quad (5)$$

(Here, Sh7 is a seventh relative speed value, Ha is a modified width decision value, K is a reference value with respect to the provided width decision value or the provided height decision value, and Vf is a provided height decision value.)

The reference value K corresponds to an initially-provided width decision value and an initially-provided height decision value. The initially-provided width decision value and the initially-provided height decision value are set to the same value. For example, if the reference value K is 100, the provided width decision value and the provided height decision value are 100% respectively and the modified width decision value and the modified height decision value are 120% respectively, the seventh relative speed value may be "120×100÷100=120" using Equation 5.

After operation 50, in operation 52, an eighth relative speed value of the motor placed vertically, which corresponds to the seventh relative speed value, is decided. The eighth relative speed value is decided by Equation 6.

$$Sv8=Vf\times K\div Sh7 \quad (6)$$

For example, by using the above-mentioned conditions and results assumed in operation 50 the eighth relative speed value may be "100×100÷120=10000/120" using Equation 6.

After operation 52, in operation 54, a ninth relative speed value of the motor placed vertically is decided. The ninth relative speed value is decided by Equation 7.

$$Sv9=Va\times K\div Hf \quad (7)$$

(Here, Sv9 is a ninth relative speed value, Va is a modified height decision value, and Hf is a provided width decision value.)

For example, by using the above-mentioned conditions and results assumed in operation 50, the ninth relative speed value may be "120×100÷100=120" using Equation 7.

After operation 54, in operation 56, a tenth relative speed value of the motor placed horizontally, which corresponds to the ninth relative speed value, is decided.

The tenth relative speed value is decided by Equation 8.

$$Sh10=Hf\times K\div Sv9 \quad (8)$$

(Here, Sh10 is the tenth relative speed value.)

For example, by using the above-mentioned conditions and results assumed in operation 50 the tenth relative speed value may be "100×100÷120=10000/120" using Equation 8.

After operation 56, in operation 58, an average value between the seventh decided relative speed value and the tenth decided relative speed value is obtained, and the average value is decided as a fifth relative speed value, and an average value between the eighth decided relative speed value and the ninth decided relative speed value is obtained, and the average value is decided as a sixth relative speed value. For example, by using the above-mentioned conditions and results assumed in operation 50 "610/6" may be obtained by obtaining an average value between the seventh relative speed value "120" and the tenth relative speed value "10000/120". Similarly, "610/6" may be obtained by obtaining an average value between the eighth relative speed value "120" and the ninth relative speed value "10000/120". "610/6", which is the average value between the seventh relative speed value and the tenth relative speed value, is decided as the fifth relative speed value. Also, "610/6", which is the average value between the eighth relative speed value and the ninth relative speed value, is decided as the sixth relative speed value.

Figure 4:
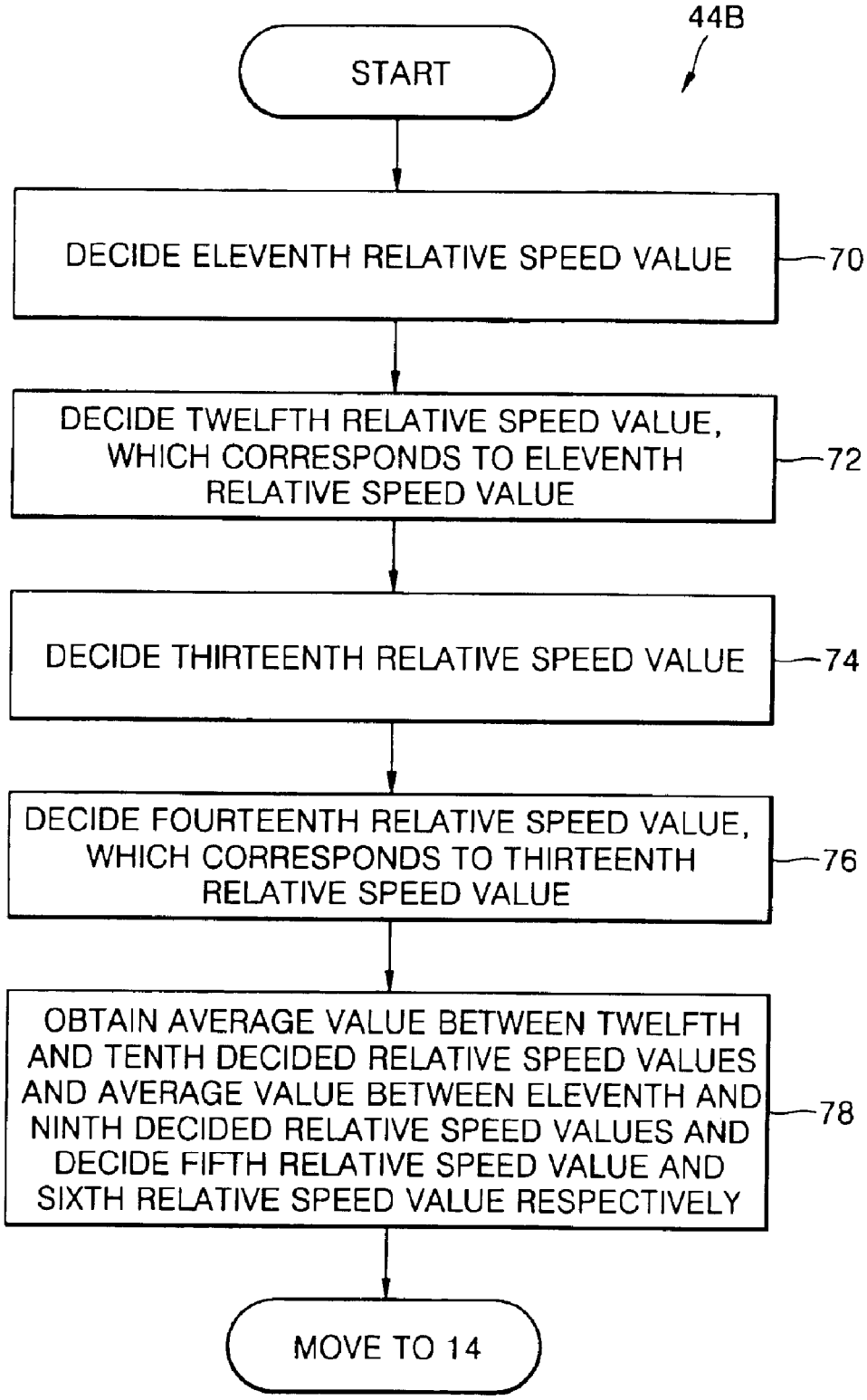
FIG. 4 is a flowchart illustrating another embodiment of operation 44 shown in FIG. 2, according to the present invention.

FIG. 4 is a flowchart illustrating another embodiment 44B of operation 44 shown in FIG. 2, according to the present invention. The embodiment 44B comprises the operations 70 through 78 of deciding a twelfth relative speed value, which corresponds to an eleventh relative speed value, and a fourteenth relative speed value, which corresponds to a thirteenth relative speed value, and obtaining an average value between the twelfth decided relative speed value and the thirteenth decided relative speed value and an average value between the eleventh decided relative speed value and the fourteenth decided relative speed value. The operations 70 through 76 are preformed in a reverse order of the above-mentioned operations 50 through 56.

First, in operation 70, the eleventh relative speed value of the motor placed vertically is decided. The eleventh relative speed value is decided by Equation 9.

$$Sv11=Va\times K\div Hf \quad (9)$$

(Here, Sv11 is an eleventh relative speed value, Va is a modified height decision value, K is a reference value with respect to a provided width decision value or a provided height decision value, and Hf is a provided width decision value.)

After operation 70, in operation 72, a twelfth relative speed value of the motor placed horizontally, which corresponds to the eleventh relative speed value, is decided. The twelfth relative speed value is decided by Equation 10.

$$Sv12=Hf\times K\div Sv11 \quad (10)$$

(Here, Sh12 is a twelfth relative speed value.)

After operation 72, in operation 74, a thirteenth relative speed value of the motor placed horizontally is decided. The thirteenth relative speed value is decided by Equation 11.

$$Sh13=Ha\times K\div Vf \quad (11)$$

(Here, Sh13 is a thirteenth relative speed value, Ha is a modified width decision value, and Vf is a provided height decision value.)

After operation 74, in operation 76, a fourteenth relative speed value of the motor placed vertically, which corresponds to the thirteenth relative speed value, is decided. The fourteenth relative speed value is decided by Equation 12.

$$Sv14=Vf\times K\div Sh11 \quad (12)$$

(Here, Sv4 is a fourteenth relative speed value.)

After operation 76, in operation 78, an average value between the twelfth decided relative speed value and the thirteenth decided relative speed value is obtained, and the average value is decided as a fifth relative speed value, and an average value between the eleventh decided relative speed value and the fourteenth decided relative speed value is obtained, and the average value is decided as a sixth relative speed value.

The above-mentioned fifth relative speed value corresponds to the speed value of the motor placed horizontally in operation 12, and the above-mentioned sixth relative speed value corresponds to the speed value of the motor placed vertically in operation 12.

Meanwhile, after operation 12, in operation 14, the motors placed horizontally and vertically are driven in accordance with the decided speed values of the motors, and data is printed. Specifically, the motors placed horizontally and vertically are driven in accordance with the decided speed values of the motors, i.e., the first and second relative speed values, the third and fourth relative speed values, or the fifth and sixth relative speed values, and the data is printed. As such, a printing operation can be performed to be suitable for a predetermined format desired by a user.

Hereinafter, an apparatus to adjust a printing width of a printing paper according to the present invention will be described with reference to the accompanying drawings.

Figure 5:
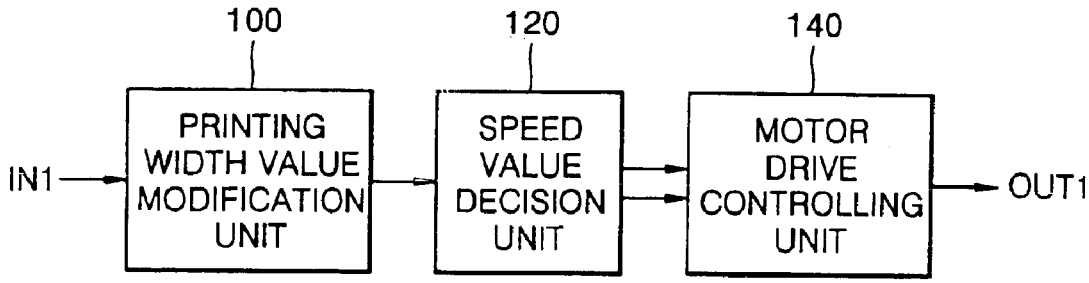
FIG. 5 is a block diagram illustrating an embodiment of an apparatus that adjusts a printing width of a printing paper according to the present invention.

FIG. 5 is a block diagram illustrating an embodiment of an apparatus to adjust a printing width of a printing paper according to the present invention. The apparatus to adjust a printing width of a printing paper includes a printing width value modification unit 100, a speed value decision unit 120, and a motor drive controlling unit 140.

In order to perform operation 10, the printing width value modification unit 100 has a width decision value to decide a width of a printing paper or a height decision value to decide a height of the printing paper, modifies the width decision value or the height decision value in response to a user's modification request signal, and outputs the result of modification. For example, the printing width value modification unit 100 receives the user's modification request signal through an input terminal IN1, modifies the width decision value or the height decision value into a percentage, and outputs the result of modification to the speed value decision unit 120.

In order to perform operation 12, the speed value decision unit 120 decides speed values of motors placed horizontally and vertically in response to the result of modification and outputs the results of the decision. The speed values of the motors placed horizontally and vertically are relative motor speed values between the motors, which are placed horizontally and vertically and driven during a printing operation. The speed value decision unit 120 decides the relative motor speed values between the motors in response to the result of modification received from the printing width value modification unit 100 and outputs the results of the decision to the motor drive controlling unit 140.

Figure 6:
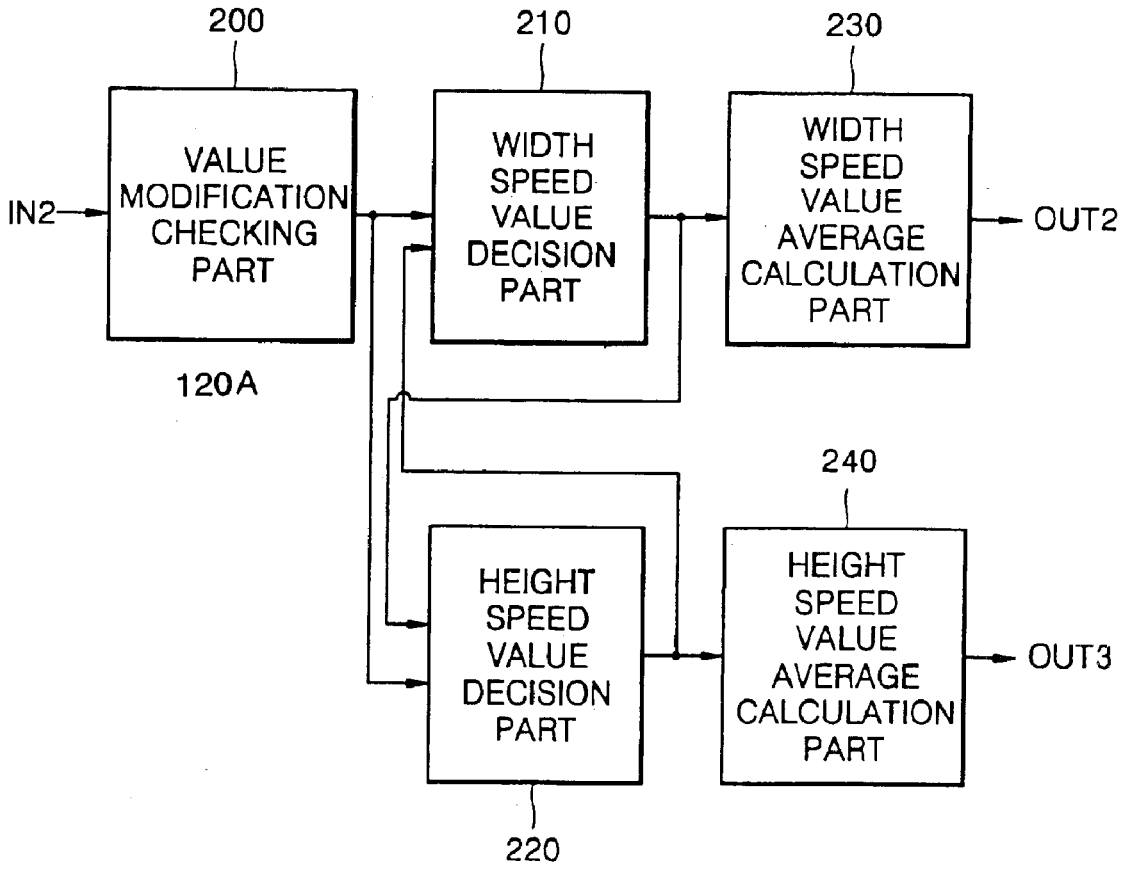
FIG. 6 is a block diagram illustrating an embodiment of a speed value decision unit shown in FIG. 5, according to the present invention.

FIG. 6 is a block diagram illustrating an embodiment 120A of a speed value decision unit 120 shown in FIG. 5, according to the present invention. The speed value decision unit 120 includes a value modification checking part 200, a width speed value decision part 210, a height speed value decision part 220, a width speed value average calculation part 230, and a height speed value average calculation part 240.

In order to perform operations 30, 32, and 38, the value modification checking part 200 checks whether a width decision value or a height decision value is modified by a user, and outputs the result of checking. The value modification checking part 200 receives the result of modification from the printing width value modification unit 100 through an input terminal IN2, checks whether the width decision value or the height decision value is modified by the user, and outputs the result of checking to the width speed value decision part 210 and the height speed value decision part 220.

In order to perform operations 34 and 42, the width speed value decision part 210 decides a first relative speed value of the motor placed horizontally or decides a fourth relative speed value of the motor placed horizontally corresponding to a third decided relative speed value of the motor placed vertically, in response to the result of checking and outputs the results of the decision. The width speed value decision part 210 receives the result, in which the width decision value is modified, from the value modification checking part 200 and decides the first relative speed value of the motor placed horizontally. The first relative speed value is decided using the above-mentioned Equation 1. Also, the width speed value decision part 210 decides the fourth relative speed value, which corresponds to the third relative speed value input from the height speed value decision part 220. The fourth relative speed value is decided using the above-mentioned Equation 4.

Also, in order to perform operations 50 and 56, the width speed value decision part 210 decides a seventh relative speed value of the motor placed horizontally or decides a tenth relative speed value of the motor placed horizontally corresponding to the ninth decided relative speed value of the motor placed vertically, in response to the result of checking and outputs the results of the decision. The width speed value decision part 210 receives the result, in which the width decision value is modified, from the value modification checking part 200 and decides the seventh relative speed value of the motor placed horizontally. The seventh relative speed value is decided using the above-mentioned Equation 5. Also, the width speed value decision part 210 decides the tenth relative speed value, which corresponds to the ninth relative speed value input from the height speed value decision part 220. The tenth relative speed value is decided using the above-mentioned Equation 8.

Also, in order to perform operations 72 and 74, the width speed value decision part 210 decides a thirteenth relative speed value of the motor placed horizontally or decides a twelfth relative speed value of the motor placed horizontally corresponding to the eleventh decided relative speed value of the motor placed vertically, in response to the result of checking and outputs the results of the decision. The width speed value decision part 210 receives the result, in which the width decision value is modified, from the value modification checking part 200 and decides the thirteenth relative speed value of the motor placed horizontally. The thirteenth relative speed value is decided using the above-mentioned Equation 11. Also, the width speed value decision part 210 decides the twelfth relative speed value, which corresponds to the eleventh relative speed value input from the height speed value decision part 220. The twelfth relative speed value is decided using the above-mentioned Equation 10.

The width speed value decision part 210 outputs the results of the decision to the width speed value average calculation part 230.

In order to perform operations 36 and 40, the height speed value decision part 220 decides a third relative speed value of the motor placed vertically or decides a second relative speed value of the motor placed vertically corresponding to the first relative speed value decided by the width speed value decision part 210, in response to the result of checking and outputs the results of the decision. The height speed value decision part 220 receives the result, in which the height decision value is modified, from the value modification checking part 200 and decides the third relative speed value of the motor placed vertically. The third relative speed value is decided using the above-mentioned Equation 3. Also, the height speed value decision part 220 decides the second relative speed value, which corresponds to the first relative speed value input from the width speed value decision part 210. The second relative speed value is decided using the above-mentioned Equation 2.

Also, in order to perform operations 52 and 54, the height speed value decision part 220 decides a ninth relative speed value of the motor placed vertically or decides an eighth relative speed value of the motor placed vertically, which corresponds to the seventh decided relative speed value of the motor placed horizontally, in response to the result of checking and outputs the results of the decision. The height speed value decision part 220 receives the result, in which the height decision value is modified, from the value modification checking part 200 and decides the ninth relative speed value of the motor placed vertically. The ninth relative speed value is decided using the above-mentioned Equation 7. Also, the height speed value decision part 220 decides the eighth relative speed value, which corresponds to the seventh relative speed value input from the width speed value decision part 210. The eighth relative speed value is decided using the above-mentioned Equation 6.

Also, in order to perform operations 70 and 76, the height speed value decision part 220 decides an eleventh relative speed value of the motor placed vertically or decides a fourteenth relative speed value of the motor placed vertically corresponding to the thirteenth relative speed value of the motor placed horizontally, and outputs the results of the decision. The height speed value decision part 220 receives the result, in which the height decision value is modified, from the value modification checking part 200 and decides the eleventh relative speed value of the motor placed vertically. The eleventh relative speed value is decided using the above-mentioned Equation 9. Also, the height speed value decision part 220 decides the fourteenth relative speed value, which corresponds to the thirteenth relative speed value input from the width speed value decision part 210. The fourteenth relative speed value is decided using the above-mentioned Equation 12.

The height speed value decision part 220 outputs the results of the decision to the height speed value average calculation part 240.

In order to perform operation 58, the width speed value average calculation part 230 calculates an average value between the seventh relative speed value and the tenth relative speed value, in response to the results input from the width speed value decision part 210 and outputs the calculated average value.

Also, in order to perform operation 78, the width speed value average calculation part 230 calculates an average value between the twelfth relative speed value and the thirteenth relative speed value, in response to the results input from the width speed value decision part 210 and outputs the calculated average value.

The width speed value average calculation part 230 outputs the calculated average value to an output terminal OUT2.

In order to perform operation 58, the height speed value average calculation part 240 calculates an average value between the eighth relative speed value and the ninth relative speed value in response to the results input from the height speed value decision part 220 and outputs the calculated average value.

Also, in order to perform operation 78, the height speed value average calculation part 240 calculates an average value between the eleventh relative speed value and the fourteenth relative speed value, in response to the results input from the height speed value decision part 220 and outputs the calculated average value.

The height speed value average calculation part 240 outputs the calculated average value to an output terminal OUT3.

As shown in FIGS. 2, 3, and 4, after operations 36, 42, 44, 58, and 78 are completed operation 14 is undertaken. In order to perform operation 14, the motor drive controlling unit 140 drives the motors placed horizontally and vertically, in accordance with the decided speed values of the motors in response to the results of the decision. The motor drive controlling unit 140 drives the motors placed horizontally and vertically, in accordance with the speed values of the motors input from the speed value decision unit 120, i.e., the first and second relative speed values, the third and fourth relative speed values, or the fifth and sixth relative speed values.

As described above, in the method and apparatus to adjust a printing width of a printing paper according to the present invention, a user can adjust the speed of the motors used to decide the width and height of the printing paper such that the user can print the width or height of printing material in a desired format.

While this invention has been particularly shown and described with reference to preferred embodiments thereof, it will be understood by those skilled in the art that various changes in form and details may be made therein without departing from the spirit and scope of the invention as defined by the appended claims.

Although a few preferred embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A method of adjusting a printing width of a printing paper performed in a printer that drives motors placed horizontally and vertically and that prints data, the method comprising:

modifying a previously-provided width decision value used to decide a width of the printing paper or a previously-provided height decision value used to decide a height of the printing paper;

deciding a speed value of the motor placed horizontally and a speed value of the motor placed vertically from the modified width decision value or the modified height decision value; and driving the motors placed horizontally and vertically in accordance with the decided speed values of the motors placed horizontally and vertically and printing the data.

2. The method of claim 1, wherein the operation of deciding comprises:

determining whether both the width decision value and the height decision value have been modified;

if it is determined that both the width decision value and the height decision value have not been modified, determining whether the width decision value is modified;

if it is determined that the width decision value has been modified, deciding a first relative speed value of the motor placed horizontally;

deciding a second relative speed value of the motor placed vertically, which corresponds to the first relative speed value;

if it is determined that the width decision value has not been modified, determining whether the height decision value has been modified;

if it is determined that the height decision value has been modified, deciding a third relative speed value of the motor placed vertically;

deciding a fourth relative speed value of the motor placed horizontally, which corresponds to the third relative speed value; and if it is determined that both the width decision value and the height decision value have been modified, deciding a fifth relative speed value of the motor placed horizontally and a sixth relative speed value of the motor placed vertically, wherein each of the first, fourth, and fifth relative speed values is the speed value of the motor placed horizontally, and each of the second, third, and sixth relative speed values is the speed value of the motor placed vertically.

3. The method of claim 2, wherein the first relative speed value is decided by the equation, $$Sh1=Ha\times K\div Vf,$$

where Sh1 is the first relative speed value, Ha is the modified width decision value, K is a reference value with respect to the provided width decision value or the provided height decision value, and Vf is the provided height decision value.

4. The method of claim 3, wherein the second relative speed value is decided by the equation, $$Sv2=Vf\times K\div Sh1,$$

where Sv2 is the second relative speed value.

5. The method of claim 2, wherein the third relative speed value is decided by the equation, $$Sv3=Va\times K\div Hf,$$

where Sv3 is the third relative speed value, Va is the modified height decision value, K is a reference value with respect to the provided width decision value or the provided height decision value, and Hf is the provided width decision value.

6. The method of claim 5, wherein the fourth relative speed value is decided by the equation, $$Sh4=Hf\times K\div Sv3,$$

where Sh4 is the fourth relative speed value.

7. The method of claim 2, wherein the operation of deciding the fifth relative speed value at the motor placed horizontally and the sixth relative speed value of the motor placed vertically comprises:

deciding a seventh relative speed value of the motor placed horizontally;

deciding an eighth relative speed value of the motor placed vertically, which corresponds to the seventh relative speed value;

deciding a ninth relative speed value of the motor placed vertically;

deciding a tenth relative speed value of the motor placed horizontally, which corresponds to the ninth relative speed value; and obtaining an average value between the seventh decided relative speed value and the tenth decided relative speed value, deciding the average value as the fifth relative speed value, obtaining an average value between the eighth decided relative speed value and the ninth decided relative speed value, and deciding the average value as the sixth relative speed value.

8. The method of claim 7, wherein the seventh relative speed value is decided by $$Sh7=Ha\times K\div Vf,$$

where Sh7 is the seventh relative speed value, Ha is the modified width decision value, K is a reference value with respect to the provided width decision value or the provided height decision value, and Vf is the provided height decision value.

9. The method of claim 8, wherein the eighth relative speed value is decided by $$Sv8=Vf\times K\div Sh7,$$

where Sv8 is the eighth relative speed value.

10. The method of claim 9, wherein the ninth relative speed value is decided by $$Sv9=Va\times K\div Hf,$$

where Sv9 is the ninth relative speed value, Va is the modified height decision value, and Hf is the provided width decision value.

11. The method of claim 10, wherein the tenth relative speed value is decided by $$Sh10=Hf\times K\div Sv9,$$

where Sh10 is the tenth relative speed value.

12. The method of claim 2, wherein the operation of deciding the fifth relative speed value of the motor placed horizontally and the sixth relative speed value of the motor placed vertically further comprises:

deciding an eleventh relative speed value of the motor placed vertically;

deciding a twelfth relative speed value of the motor placed horizontally, which corresponds to the eleventh relative speed value;

deciding a thirteenth relative speed value of the motor placed horizontally;

deciding a fourteenth relative speed value of the motor placed vertically, which corresponds to the thirteenth relative speed value; and obtaining an average value between the twelfth decided relative speed value and the thirteenth decided relative speed value, deciding the average value as the fifth relative speed value, obtaining an average value between the eleventh decided relative speed value and the fourteenth decided relative speed value, and deciding the average value as the sixth relative speed value.

13. An apparatus that adjusts a printing width of a printing paper included in a printer that drives motors placed horizontally and vertically and that prints data, the apparatus comprising:

a printing width value modification unit having a width decision value to decide a width of the printing paper, or a height decision value to decide a height of the printing paper, that modifies the width decision value or the height decision value in response to a user's modification request signal, and outputs the result of modification;

a speed value decision unit deciding speed values of motors placed horizontally and vertically in response to the result of modification and outputs the results of the decision; and a motor drive controlling unit driving the motors placed horizontally and vertically, in accordance with the decided speed values of the motors in response to the results of the decision.

14. The apparatus of claim 13, wherein the speed value decision unit comprises:

a value modification checking part checking whether the width decision value or the height decision value is modified by a user, and which outputs the result of checking;

a width speed value decision part deciding a first relative speed value of the motor placed horizontally or decides a fourth relative speed value of the motor placed horizontally corresponding to a third decided relative speed value of the motor placed vertically, in response to the result of checking, and outputs the results of the decision; and a height speed value decision part which decides a third relative speed value of the motor placed vertically or decides a second relative speed value of the motor placed vertically corresponding to the first relative speed value decided by the width speed value decision part, in response to the result of checking, and outputs the results of the decision.

15. The apparatus of claim 14, wherein the width speed value decision part decides a seventh relative speed value of the motor placed horizontally or decides a tenth relative speed value of the motor placed horizontally corresponding to a ninth decided relative speed value of the motor placed vertically, in response to the result of checking, and outputs the results of the decision.

16. The apparatus of claim 15, wherein the height speed value decision part decides a ninth relative speed value of the motor placed vertically or decides an eighth relative speed value of the motor placed vertically corresponding to the seventh decided relative speed value, in response to the result of checking, and outputs the results of the decision.

17. The apparatus of claim 16, wherein the speed value decision unit further comprises:

a width speed value calculation part which calculates an average value between the seventh relative speed value and the tenth relative speed value, in response to the results input from the width speed value decision part and outputs the calculated average value; and a height speed value calculation part which calculates an average value between the eighth relative speed value and the ninth relative speed value, in response to the results input from the height speed value decision part and outputs the calculated average value.

18. A method of adjusting a printing width of a printing paper, the method comprising:

selectively modifying at least one of a previous width decision value used to decide a width of the printing paper and a previous height decision value used to decide a height of the printing paper;

deciding a speed value of the motor placed horizontally and a speed value of the motor placed vertically from the selectively modified width decision value and the modified height decision value; and driving the motors placed horizontally and vertically according to the decided speed values of the motors placed horizontally and vertically.

19. An apparatus, including first and second motors to drive printing operations, to adjust a printing width of a printing paper, comprising:

a printing width value modification unit having both a width decision value to decide a width of the printing paper, and a height decision value to decide a height of the printing paper, that selectively modifies at least one of the width decision value and the height decision value in response to a user's modification request signal, and outputs the result of modification;

a speed value decision unit to decide speed values of the first and second motors in response to the result of modification and outputs the results of the decision; and a motor drive controlling unit to drive the first and second motors according to the decided speed values of the motors in response to the results of the decision.

* * * * *

UNITED STATES PATENT AND TRADEMARK OFFICE

CERTIFICATE OF CORRECTION

PATENT NO. : 6,883,986 B2
DATED : April 26, 2005
INVENTOR(S) : Hong-rok Woo

It is certified that error appears in the above-identified patent and that said Letters Patent is hereby corrected as shown below:

Column 14,
Line 36, before "." insert -- , wherein the first motor is placed horizontally and the second motor is placed vertically --.

Signed and Sealed this

Twenty-seventh Day of December, 2005

JON W. DUDAS
*Director of the United States Patent and Trademark Office*